US010486437B2

(12) United States Patent
Hauck

(10) Patent No.: US 10,486,437 B2
(45) Date of Patent: Nov. 26, 2019

(54) METHOD OF PRINTING A PRINT CONTROL STRIP ONTO A SHEET OF PRINTING MATERIAL

(71) Applicant: HEIDELBERGER DRUCKMASCHINEN AG, Heidelberg (DE)

(72) Inventor: Axel Hauck, Karlsruhe (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 16/278,974

(22) Filed: Feb. 19, 2019

(65) Prior Publication Data

US 2019/0255864 A1 Aug. 22, 2019

(30) Foreign Application Priority Data

Feb. 16, 2018 (DE) ..... 10 2018 202 388

(51) Int. Cl.
*B41J 11/00* (2006.01)

(52) U.S. Cl.
CPC ..... *B41J 11/0015* (2013.01); *B41J 11/0095* (2013.01)

(58) Field of Classification Search
CPC ..... B41J 11/0015; B41J 11/0095
See application file for complete search history.

(56) References Cited

U.S. PATENT DOCUMENTS 4,947,746 A * 8/1990 Jeschke ..... B41F 33/0081 101/181
8,630,486 B2 1/2014 Fuchsenthaler

FOREIGN PATENT DOCUMENTS

| | | | |
|---|---|---|---|
| DE | 3643721 | A1 | 6/1988 |
| DE | 102008056170 | A1 | 6/2009 |
| DE | 102008025417 | A1 | 12/2009 |
| DE | 102008057951 | A1 | 5/2010 |
| DE | 102010051952 | A1 | 6/2011 |
| DE | 102014223579 | A1 | 5/2016 |
| DE | 102016224303 | A1 | 6/2018 |

* cited by examiner

*Primary Examiner* — Bradley W Thies
(74) *Attorney, Agent, or Firm* — Laurence A. Greenberg; Werner H. Stemer; Ralph E. Locher

(57) ABSTRACT

A method for printing a print control strip onto a sheet of printing material. The print control strip is divided into strip sections and the strip sections are printed into gripper gaps at the leading sheet edge and/or the trailing sheet edge of the sheet. In a variant embodiment, there is also printed a print control strip onto two sheets of printing material. The print control strip is divided into at least two portions of respective strip sections and the strip sections of a first portion and of a second portion are printed into respective gripper gaps at at least one sheet edge of a first sheet and of a second sheet, respectively. Waste production is eliminated or at least reduced and costs are thus lowered.

12 Claims, 3 Drawing Sheets

METHOD OF PRINTING A PRINT CONTROL STRIP ONTO A SHEET OF PRINTING MATERIAL

CROSS-REFERENCE TO RELATED APPLICATION

This application claims the priority, under 35 U.S.C. § 119, of German patent application DE 10 2018 202 388.3, filed Feb. 16, 2018; the prior application is herewith incorporated by reference in its entirety.

BACKGROUND OF THE INVENTION

Field of the Invention

The invention lies in the field of the graphic industries and in particular in the field of industrial inkjet printing on flat substrates, i.e., the application of liquid ink to sheet-shaped printing material, preferably made of paper, paperboard, cardboard or plastic.

In accordance with the prior art, sheet-shaped printing material (i.e., printing material sheets) made of paper, for instance, are mainly guided through the inkjet printing machine and past the print heads thereof in close proximity to the latter to receive the print while resting on transport cylinders, belts, or so-called tablets. In accordance with the prior art, the sheets are frequently held by (clamping) grippers including so-called leading-edge grippers and trailing-edge grippers for holding the sheets at the leading edges and trailing edges thereof, respectively. Such grippers are usually disposed transversely to the direction of sheet transport and next to one another but spaced apart from one another on gripper bars. The areas on the sheet where the sheet is held by the grippers cannot be printed on. Waste is the result.

In accordance with the prior art, a print control strip is frequently printed onto the printing material for printing process control purposes. In general, this strip is printed at the margins of the printing material, e.g. close to the leading edge of a sheet of printing material. The strip is subsequently recorded by a sensor or camera inside the printing machine (in line) or outside the printing machine (off line) and analyzed by a computer. In accordance with the prior art, in inkjet printing, such a strip may include a nozzle test chart for detecting individual nozzles that fail to apply ink or apply ink at an undesired angle. Print control strips are usually cut off when the printed products are submitted to further processing and therefore result in waste.

U.S. Pat. No. 4,947,746 and German published patent applications DE 36 43 721 A1 and DE 10 2014 223 579 A1, respectively, disclose a print control strip for offset printing; the commonly assigned and yet unpublished German patent application No. DE 10 2016 224 303 discloses a printing nozzle test chart for inkjet printing.

BRIEF SUMMARY OF THE INVENTION

It is accordingly an object of the invention to provide a method of printing a print control strip which overcomes the above-mentioned and other disadvantages of the heretofore-known devices and methods of this general type and which, in particular, avoids or at least reduce the creation of waste during a printing operation in order to lower costs.

With the foregoing and other objects in view there is provided, in accordance with the invention, a method of printing a print control strip onto a sheet of printing material, the method comprising:

dividing the print control strip into strip sections; and printing the strip sections into gripper gaps defined in at least one sheet edge margin of the sheet "Printing material" may refer to paper, paperboard, cardboard (including corrugated board), or plastic film, each in sheet form.

"Print control strips" may comprise standardized precision measurement strips including measuring fields for four-color printing, for instance, which are used to monitor coloration, color balance, dot gain, register accuracy, halftone, and color density in the print. "Print control strips" may further include nozzle test charts for detecting missing and/or angled nozzles.

The invention relates to a method for printing a print control strip onto a sheet of printing material wherein the print control strip is subdivided into strip sections and the strip sections are printed into gripper gaps at at least one sheet edge of the sheet, i.e., at the leading edge and/or at the trailing edge of the sheet.

The invention advantageously avoids or at least reduces the waste that is curing during the printing operation, thus effectively lowering production costs.

An advantage of the invention is that the gripper gaps on the sheets, i.e. the gaps or spaces between adjacent grippers that are spaced apart from one another, in particular gripper fingers of clamping grippers, are used as locations for print control strips or rather sections thereof, thus increasing the amount of space that is available on the sheets for the actual print. This avoids or at least reduces waste. For example, the unprinted margin in inkjet printing may be 1 cm, i.e. approximately 1/70 (or approximately 1.4%) of the surface area of a 70×100 (70 cm×100 cm) sheet.

In accordance with an added feature of the invention, the strip sections are printed into adjacent gripper gaps.

In accordance with an additional feature of the invention, the strip sections are printed at the leading edge of the sheet.

In accordance with another feature of the invention, the strip sections are printed at the trailing edge of the sheet.

In accordance with yet another feature of the invention, the strip sections are printed at the leading edge and at the trailing edge of the sheet.

With the above and other objects in view there is also provided, in accordance with the invention, a method for printing a print control strip onto two sheets of printing material. Here, the print control strip is divided into at least two portions of respective strip sections and the strip sections of a first portion and of a second portion are respectively printed into gripper gaps at at least one sheet edge of a first sheet and of a second sheet, respectively.

In other words, the invention thus distributes the print control strip to two or more than two sheets. Thus the analysis of the distributed print control strip is preferably done in such a way that two or more sheets are recorded by a sensor or camera and the two or more portions that have been recorded in this process are recombined to form a single print control strip for joint processing or are processed separately during the computer analysis.

The invention advantageously avoids or at least reduces waste and lowers production costs. The advantages that may be attained are the same as indicated above.

In this context, a particularly favorable further feature is to print the two portions of respective strip sections in such a way that they are offset in a lateral direction (i.e. transverse to the direction of sheet transport). The first portion may, for instance, be printed on locations of the first sheet that correspond to locations on the second sheet where the second sheet is held by grippers and vice versa. For this purpose, it is advantageous to arrange the grippers that hold the first sheet and the grippers that hold the second sheet in a way for them to be laterally offset relative to one another. In this way, (the portions of) a print control strip that extends essentially over the entire lateral width of the sheets may be printed. Or, in other words: Despite the grippers and the gaps between the grippers, a gapless print control strip may be used. It is important to ensure that when a sheet is transferred for instance from one cylinder to another, the grippers of the upstream and downstream gripper systems are offset relative to one another in a way to prevent gripper collisions.

In accordance with again an added feature of the invention, the strip sections of every portion are printed into adjacent gripper gaps.

In accordance with again an additional feature of the invention, the strip sections are printed onto the leading edges of the two sheets.

In accordance with again another feature of the invention, the printing is achieved by the application of ink drops into the gripper gaps.

In accordance with a concomitant feature of the invention, coating drops are applied to the gripper gaps before the ink drops are applied to the same gripper gaps.

Other features which are considered as characteristic for the invention are set forth in the appended claims. It will be understood that the various features of the invention, of further developments of the invention, and of the exemplary embodiments of the invention may be combined with one another in any desired way to create advantageous further developments of the invention.

Although the invention is illustrated and described herein as embodied in a method for printing a print control strip onto a sheet of printing material, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

Structurally and functionally corresponding elements have the same reference symbols throughout the figures.

DETAILED DESCRIPTION OF THE INVENTION

Figure 1A:
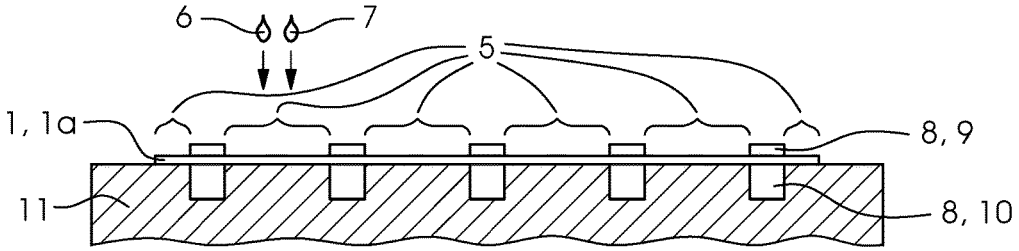
FIG. 1A is a front view illustrating a device for implementing the method according to the invention.

Referring now to the figures of the drawing in detail and first, particularly, to FIG. 1A thereof, there is shown an exemplary device for implementing a preferred embodiment of the method of the invention. There is shown a front view, i.e., a view against the direction of sheet transport.

FIG. 1A shows a sheet 1 of printing material, e.g. of paper or cardboard, or rather a first sheet 1. The leading edge 2 of the sheet is clamped between a number of grippers 8, namely between the gripper fingers 9 and gripper pads 10 thereof, that are laterally spaced apart from one another. They move the sheet through an inkjet printing machine in a direction of transport. The grippers are disposed on a sheet-conveying element 11, preferably a transport cylinder 11.

In a region of non-illustrated print heads in the inkjet printing machine, drops of ink 6 are applied to the sheet in accordance with an image. The sheet may have been coated in advance, for instance by drops of a coating 7 that are generated in an inkjet process. Alternatively, a precoated printing material may be used.

Lateral spaces 5, also referred to as gripper gaps 5, are visible between adjacent grippers 8. In accordance with the invention, a print control strip 4 (cf. FIGS. 2-4) is printed into these gripper gaps, as described below. A print control strip 4 is clearly visible in FIG. 2, for instance, which is a top view corresponding to FIG. 1A.

Figure 1B:
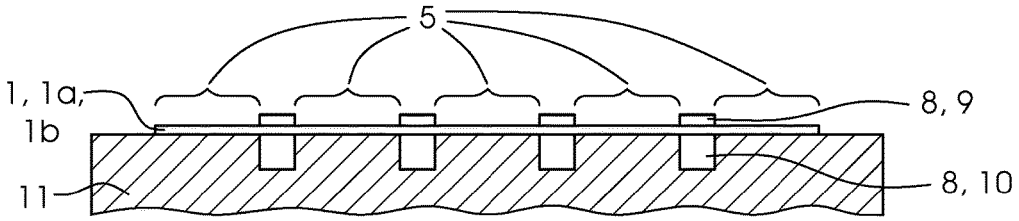
FIG. 1B illustrates a device implementing the invention.

Similarly to FIG. 1A, FIG. 1B illustrates a device implementing a preferred embodiment of the method of the invention. The sheet 1, which is being held and moved, is either the same first sheet 1*a*, which is now clamped at its trailing edge 3 by grippers 8, or a second sheet 1*b*, which is clamped at its leading edge 2. Again, there are a number of gripper gaps 5 between the grippers 8 or rather the gripper fingers 9 thereof. It is shown that the gripper gaps in FIG. 1*a* and the gripper gaps in FIG. 1*b* are laterally offset relative to one another. If the grippers 8 in FIG. 1*a* are leading-edge grippers and the grippers in FIG. 1*b* are trailing edge grippers (or vice versa), the respective grippers are disposed on the same sheet-conveying element 11 in a correspondingly offset arrangement. If the grippers 8 in FIG. 1*a* are leading-edge grippers and the grippers in FIG. 1*b* are likewise leading-edge grippers, the respective grippers are disposed in a correspondingly offset way on the circumference of a transport cylinder 11 of double or fourfold diameter. The grippers may alternatively be disposed on a transport belt or on what are known as tablets (moving transport plates) in a correspondingly offset way.

Figure 2:
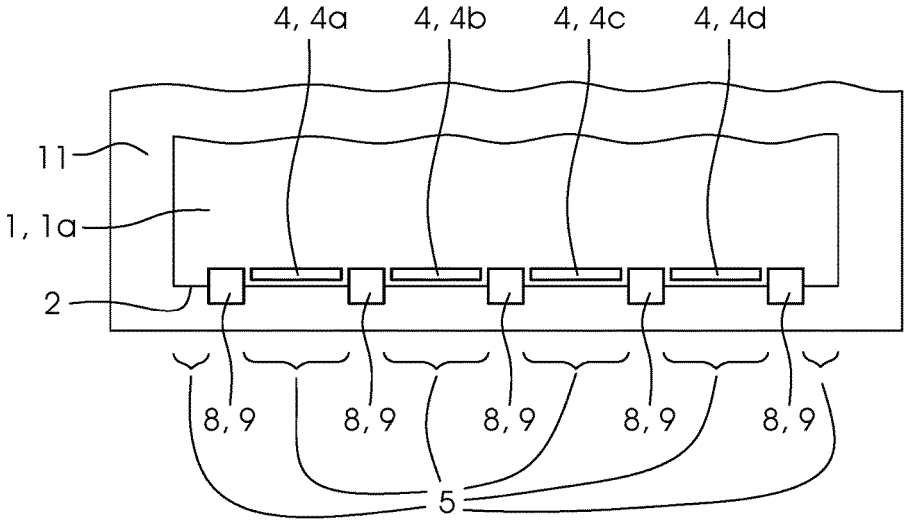
FIG. 2 illustrates a device implementing the invention.

FIG. 2 is a top view of the grippers and the sheet corresponding to FIG. 1A. It is clearly visible that a print control strip 4 has been subdivided into four strip sections 4*a* to 4*d*, for example, and every strip section is printed into a gripper gap 5 or rather onto a region of the sheet 1 that corresponds to a respective gripper gap 5. In accordance with the invention, instead of remaining unused, the marginal region of the sheet 1 close to the leading edge 2 is used. Since the strip sections are placed in the gripper gaps 5, more space is available on the sheet for the actual print, which may thus be larger. It is possible to print complete strip sections into a gripper gap, as shown, or to print a substantial surface portion of every strip section into one gripper gap, for instance 50% or 75%.

Since the print control strip 4 is interrupted at the locations of the grippers 8, the method shown in FIG. 2 is particularly suited for print control strips that have gaps themselves, i.e. strips that do not extend over the entire lateral width of the sheet 1. When different print control strips are used, one of the methods shown in FIGS. 3 and 4 is preferably used.

Figure 3:
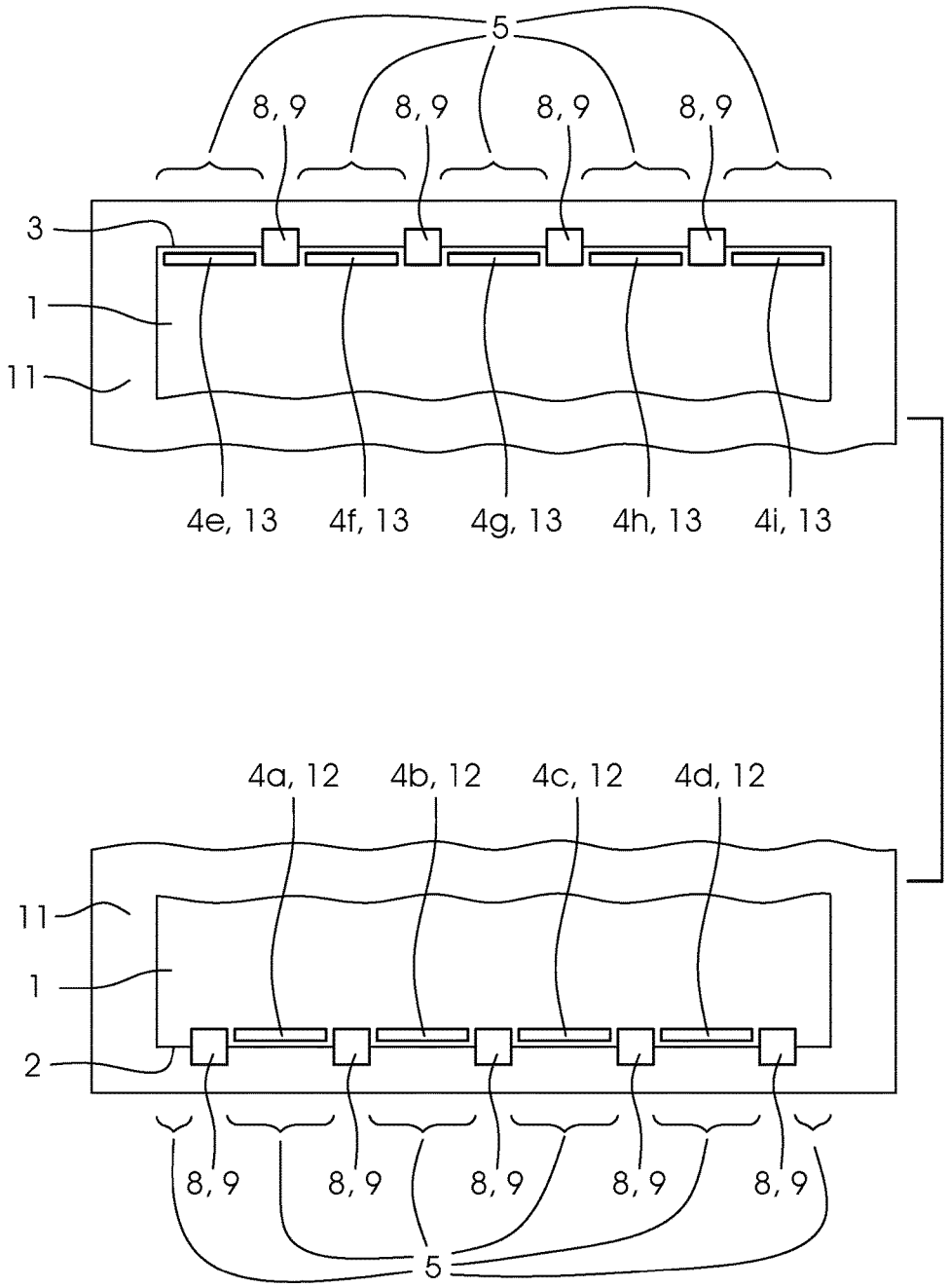
FIG. 3 illustrates a device implementing the invention.

FIG. 3 likewise illustrates a device implementing a preferred exemplary embodiment of the method of the invention. The lower section of the figure illustrates the region of the leading edge of a sheet 1; the upper section illustrates the region of the trailing edge 3 of the sheet 1 (i.e. the lower section corresponds to FIG. 1A and the upper section to FIG. 1B).

By way of example, the print control strip 4 is shown to have been subdivided into 9 strip sections 4*a* to 4*i*; a first portion 12 of strip sections 4*a* to 4*d* is printed into gripper gaps 5 between leading-edge grippers 8 and a corresponding second portion 13 of strip sections 4*e* to 4*i* is printed into gripper gaps 5 between trailing-edge grippers 8. The print control strip 4 is thus subdivided and parts of it are printed at the leading edge and parts of it are printed at the trailing edge 3 of the sheet 1. The leading-edge grippers and the trailing-edge grippers are clearly shown to be laterally offset relative to one another on the transport cylinder 11. The recording and analysis of the print control strip 4 now needs to take place at the leading edge 2 and at the trailing edge 3.

Figure 4:
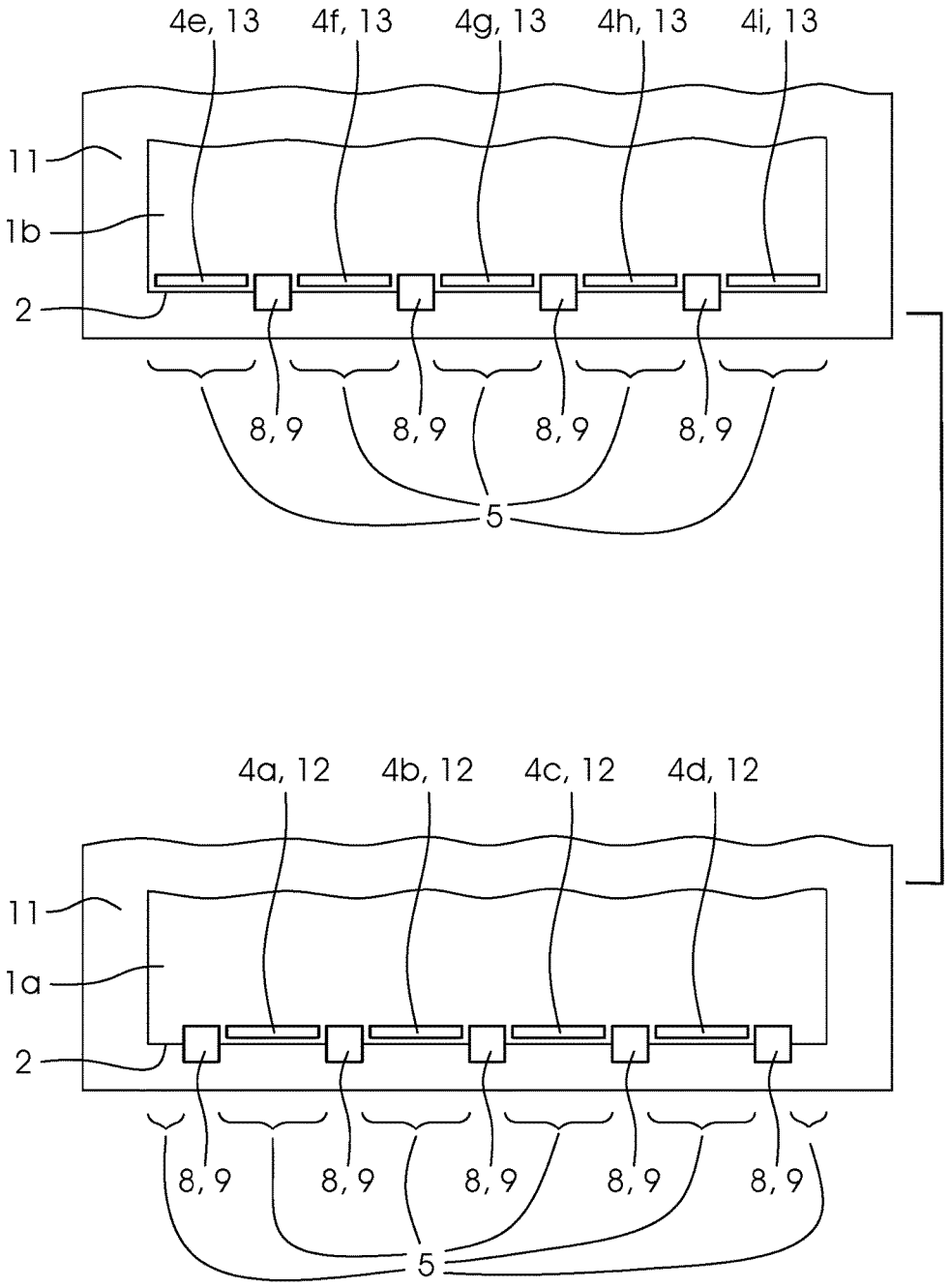
FIG. 4 illustrates a device implementing the invention.

FIG. 4 illustrates a device implementing a preferred embodiment of the method of the invention. The lower section illustrates the leading edge 2 of a first sheet 1A and the upper section illustrates the leading edge 2 of a second sheet 1B.

Here, too, it is clearly visible that a print control strip 4 has been subdivided into 9 strip sections 4*a* to 4*i*; a first portion 12 of four strip sections 4*a* to 4*d* is printed onto the first sheet 1*a* and a second portion 13 of five strip sections 4*e* to 4*i* is printed onto the second sheet 1*b*—each time on the leading edge 2. The strip sections are likewise printed into gripper gaps 5 that are laterally offset. The recording and analysis of the print control strip 5 now needs to take place over two (or more) sheets, i.e. the two portions 12 and 13 need to be separately scanned and recombined in a computational analysis.

Like the application of the ink drops 6, the application of the coating drops 7 may occur in the region of the leading edges 2 or in the region of the trailing edges 3, in particular in the gripper gaps 5.

The following is a summary list of reference numerals and the corresponding structure used in the above description of the invention:

1 sheet of printing material
1*a* first sheet of printing material
1*b* second sheet of printing material
2 leading edge of the sheet
3 trailing edge of the sheet
4 print control strip
4*a*-4*i* strip sections
5 gripper gaps
6 ink drops
7 coating drops
8 gripper
9 gripper fingers
10 gripper pads
11 cylinder
12 first part of strip sections
13 second part of strip sections

The invention claimed is:

1. A method of printing a print control strip onto a sheet of printing material, the method comprising:

dividing the print control strip into strip sections; and printing the strip sections into gripper gaps defined in at least one sheet edge margin of the sheet.

2. The method according to claim 1, which comprises printing the strip sections into mutually adjacent gripper gaps.

3. The method according to claim 2, which comprises printing the strip sections at a leading edge of the sheet.

4. The method according to claim 2, which comprises printing the strip sections at a trailing edge of the sheet.

5. The method according to claim 2, which comprises printing the strip sections at a leading edge and at a trailing edge of the sheet.

6. The method according to claim 1, which comprises printing by application of ink droplets into the gripper gaps.

7. The method according to claim 6, further comprising applying coating droplets to the gripper gaps prior to applying the ink droplets into the same gripper gaps.

8. A method for printing a print control strip onto two sheets of printing material, the method comprising:

dividing the print control strip into at least two portions of respective strip sections;

printing the strip sections of a first portion and of a second portion into respective gripper gaps at at least one sheet edge of a first sheet and of a second sheet, respectively.

9. The method according to claim 8, which comprises printing the strip sections of every portion into mutually adjacent gripper gaps.

10. The method according to claim 9, which comprises printing the strip sections at leading edges of the two sheets.

11. The method according to claim 8, which comprises printing by application of ink droplets into the gripper gaps.

12. The method according to claim 8, further comprising applying coating droplets to the gripper gaps prior to applying the ink droplets into the same gripper gaps.

* * * * *